United States Patent [19]

Willis

[11] Patent Number: 4,893,475

[45] Date of Patent: Jan. 16, 1990

[54] COMBUSTION APPARATUS FOR A GAS TURBINE

[75] Inventor: Jeffrey D. Willis, Coventry, England

[73] Assignee: Rolls-Royce plc, London, England

[21] Appl. No.: 380,749

[22] Filed: Jul. 17, 1989

Related U.S. Application Data

[63] Continuation of Ser. No. 108,912, Oct. 15, 1987, abandoned.

[30] Foreign Application Priority Data

Dec. 10, 1986 [GB] United Kingdom ..... 8629468

[51] Int. Cl.[4] ..... F23R 3/20

[52] U.S. Cl. ..... 60/732; 60/743

[58] Field of Search ..... 60/732, 734, 737, 738, 60/743

[56] References Cited

U.S. PATENT DOCUMENTS

| | | | |
|---|---|---|---|
| 3,430,443 | 3/1969 | Richardson et al. | 60/732 |
| 3,657,885 | 4/1972 | Bader | 60/737 |
| 3,703,259 | 11/1972 | Sturgess et al. | 60/743 |
| 3,906,718 | 9/1975 | Wood | 60/738 |
| 3,961,475 | 6/1976 | Wood | 60/738 |
| 4,078,377 | 3/1978 | Owens et al. | 60/737 |
| 4,362,021 | 12/1982 | Willis | 60/737 |

FOREIGN PATENT DOCUMENTS

| | | | |
|---|---|---|---|
| 2021204 | 11/1979 | United Kingdom | 60/738 |
| 2040434 | 8/1980 | United Kingdom | 60/738 |

*Primary Examiner*—Carlton R. Croyle
*Assistant Examiner*—Timothy S. Thorpe
*Attorney, Agent, or Firm*—Cushman, Darby & Cushman

[57] ABSTRACT

Combustion apparatus for a gas turbine engine comprises a burner which is so configured and located within a combustion chamber so as to urge fuel and air mixture ejected therefrom into a fuel rich toroidal vortex in an upstream first combustion zone of the combustion chamber. Unburnt fuel from the first combustion zone is mixed with additional air in a second fuel weak combustion zone downstream of the first zone. Adjustment of the air to fuel ratios in the two combustion zones results in the reduction of smoke and oxides of nitrogen reduction.

9 Claims, 1 Drawing Sheet

COMBUSTION APPARATUS FOR A GAS TURBINE

This is a continuation of application Ser. No. 108,912 filed Oct. 15, 1987 which was upon the filing hereof.

This invention relates to combustion apparatus which is suitable for a gas turbine engine.

In UK Patent number 1427146 there is described gas turbine engine combustion apparatus including a fuel injector which comprises a central duct arranged to receive a flow of compressed air and a flow of fuel, a deflecting member located adjacent the downstream end of the duct which, in cooperation with the end of the duct, forms an annular outlet for the outflow of the fuel and air mixture in a generally radial direction, and a shroud surrounding part of the central duct forming an annular duct which is arranged to receive a flow of air at its upstream end and to discharge the air from its downstream end, which is located upstream of the annular outlet from the central duct. This type of fuel injector, in conjunction with the combustion chamber in which is it located, is intended to produce two adjacent opposite handed toroidal vortices A majority of the fuel/air mixture is intended to flow into the upstream vortex where it is ignited, and the burning fuel-/air mixture flows into the downstream vortex which is partly fed by the flow from the fuel injector and partly by secondary air flowing into the combustion chamber.

It is important that the air/fuel ratio in each vortex is maintained within a certain range for the various engine operating conditions In particular, the upstream vortex should tend to be fuel rich. However it has been found that the upstream vortex is less fuel rich than is desirable indicating a migration or a disproportionate distribution of fuel from the injector into the two vortices The weak fuel/air ratio in the upstream vortex results in the production cf high temperature gases which in turn leads to problems of overheating in the upstream sections of the combustion chamber. An additional problem is that at the mean position between the two vortices there is a zone of poor air flow and high residence time This causes a severe accumulation of carbon deposits on the combustion chamber wall. Eventually these deposits grow to such a size that they become detached from the combustion chamber wall and cause erosion of the turbine downstream of the combustion chamber.

It is an object of the present invention to provide a gas turbine engine combustion system in which such problems are substantially avoided.

According to the present invention, combustion apparatus suitable for a gas turbine engine comprises a combustion chamber having a fuel burner at its upstream end, said fuel burner comprising a generally tubular member having an upstream end and a downstream end, said upstream end being positioned externally of said combustion chamber and said downstream end being positioned within said combustion chamber, said generally tubular member being adapted to be supplied in operation with compressed air and fuel and to direct a mixture of said compressed air and fuel into said combustion chamber, the downstream and of said tubular member being provided with a deflection member which is so configured as to cooperate with said tubular member to define a generally annular radially directed outlet with respect to the axis cf said tubular member for said mixture of fuel and air, said radially directed outlet being located immediately downstream of the upstream end of said combustion chamber so that said fuel and air mixture is urged into a single substantially toroidal fuel rich vortex in a first combustion zone situated in the upstream region of said combustion chamber, said combustion chamber being provided with additional air inlets downstream of said burner to direct air into a second combustion zone in said combustion chamber downstream of said toroidal vortex so as to render said second combustion zone fuel weak.

Throughout the specification, the terms "fuel rich" and "fuel weak" are used in respect of air and fuel mixtures which respectively contain more and less fuel than is necessary to sustain stoichiometric combustion The invention will now be described, by way of example, with reference to the accompanying drawings in which.

Figure 1:
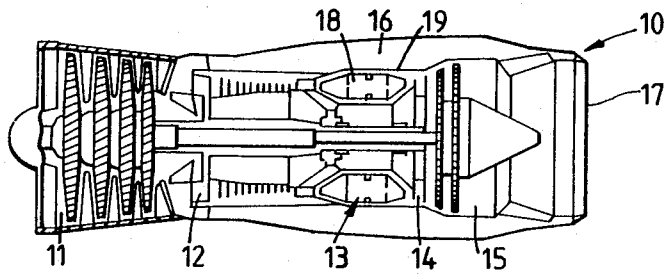
FIG. 1 is a sectioned side view of a gas turbine engine provided with combustion apparatus in accordance with the present invention.

With reference to FIG. 1, a gas turbine engine generally indicated at 10 is of conventional construction and operation and comprises a low pressure compressor 11, a high pressure compressor 12, combustion equipment 13, and a high pressure turbine 14.

Figure 2:
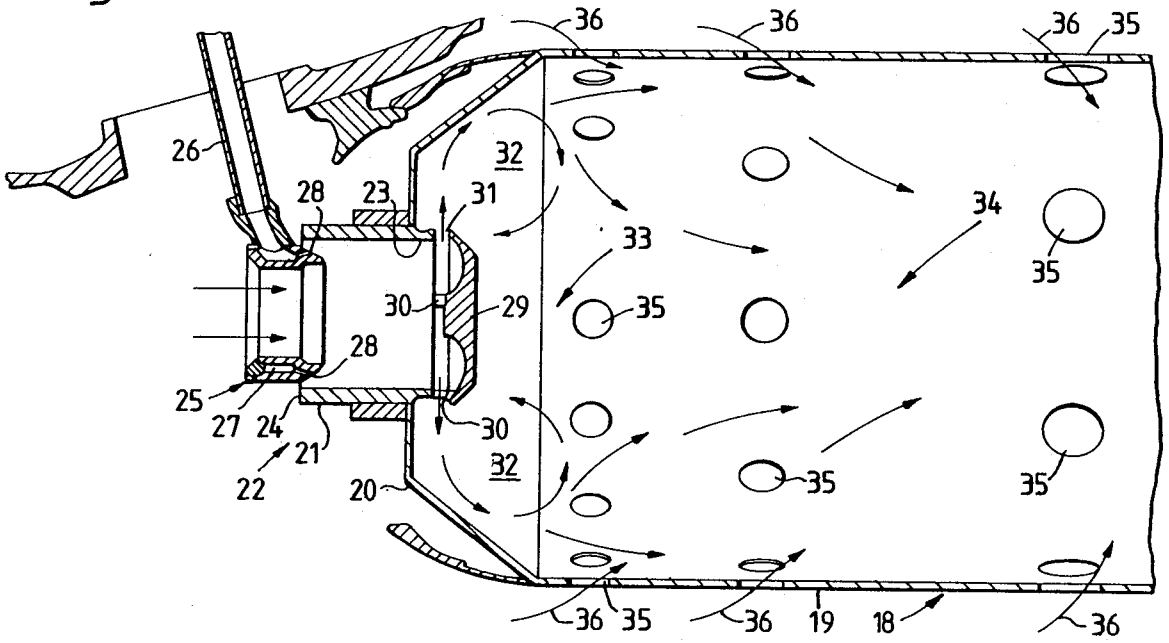
FIG. 2 is a sectioned side view of a portion of the combustion apparatus of the gas turbine engine shown in FIG. 1.

The combustion equipment 13 comprises an annular array of similar equally spaced apart combustion chambers 18, which are enclosed by an annular casing 19. Each combustion chamber 18, a portion cf which are of which can be seen more clearly in FIG. 2, comprises a generally tubular body 19 having a cap or head 20 at its upstream end. The wall of the body 19 is formed from a material which facilitates transpiration cooling thereof and which may be of the type described in UK Patent No. 1530594. The wall of the body 19 may alternatively be of more conventional construction with a plurality of suitably positioned small holes to provide cooling thereof.

The head 20 of the combustion chamber 19 carries a tubular member 21 generally centrally thereof which constitutes a portion of a burner 22. The downstream end 23 of the tubular member 21 projects a short distance into the combustion chamber 18 interior whereas its upstream end 24 together with the majority of the remainder thereof is located externally of the combustion chamber 18 and extends in a generally upstream direction (with respect to the gas flow through the engine 10) so as to receive a flow of compressed air from the high pressure compressor 12. Additional compressed air from the high pressure compressor 12 flows around the external surface of the combustion chamber 18 in order to provide cooling thereof and additional air for the combustion process as will be described later in more detail At the upstream end 24 of the tubular member 21 there is positioned a fuel spray nozzle 25 which is of the simplex type although it will be appreciated that other types of fuel spray nozzle such as the duple type, could be employed if so desired The fuel spray nozzle 25 is generally ring shaped and is supported on the radially inner extent of a fuel supply pipe 26. Fuel delivered through the pipe 26 flows into an annular manifold 27 within the fuel spray nozzle 25 from where it is directed through jets 28 on to the radially inner surface of the tubular member 21.

Air passing through and around the fuel spray nozzle 25 provides the atomisation of a large proportion of the fuel issued from the jets 28 by the time the fuel leaves the downstream end 23 of the tubular member 21. At the downstream end 23 there is located a deflecting member 29 which is axially spaced apart from the tubular member 21 by a plurality of support struts 30. An annular, radially directed outlet 31 is thus defined through which the fuel and air mixture from within the tubular member 21 is expelled in a radially outward direction with respect to the axis of the tubular member 21. Since the tubular member 21 only projects a short distance into the interior of the combustion chamber 18, the fuel and air mixture is urged by the generally frustoconical configuration of the combustion chamber head 20 into a substantially toroidal vortex 32 in the upstream zone 33 of the chamber 18. The air and fuel mixture within the vortex 32 is arranged to be fuel rich so that not all of the fuel is actually combusted in the upstream zone 33 of the chamber 18 so that overheating of the combustion chamber head 20 is avoided. The actual air to fuel ratio chosen is determined by the constraints which are imposed upon the emissions from the gas turbine engine 10. Thus if low emissions of the oxides of nitrogen are desirable, the air to fuel ratio within the vortex 32 is arranged to be within the range 7/1 to 9/1. However if it is more desirable to reduce smoke emission, then the air to fuel ratio within the vortex 32 is arranged to be within the range 9/1 to 11/1.

The combustion products from the combustion of the fuel and air mixture within the vortex 32 together with unburnt fuel then flow in a downstream direction into a second combustion zone 34 where they are mixed with air which has flowed into the combustion chamber 18 through a number of additional air inlets 35 as indicated by the arrows 36. The air flowing through the additional air inlets 35 supports the combustion of the partially burnt fuel from the first combustion zone 33. Sufficient air is directed through the additional air inlets 35 to ensure that the fuel and air mixture within the second combustion zone is fuel weak. If the air to fuel ratio within the vortex 32 falls within the range 7/1 to 9/1 to provide low oxides of nitrogen emissions, the air to fuel ratio within the second combustion zone is arranged to be within the range 22/1 to 25/1 although this combination has a tendency to increase smoke emissions. However if smoke emission reduction is of paramount importance and the air to fuel ratio within the vortex 32 to within the range 9/1 to 11/1 then the air to fuel ratio within the second combustion zone 34 is arranged to be within the range 20/1 to 22/1. Such a richer fuel mixture in the second combustion zone 34 ensures the consumption of any smoke created in the first combustion zone 33.

Although the present invention has been described with respect to combustion apparatus comprising discreet combustion chambers 18 it will be appreciated that it is also applicable to annular type combustion chambers.

Combustion equipment in accordance with the present invention, although it has been described with a by-pass aero gas turbine engine is nevertheless particularly suitable for use in industrial and marine gas turbine applications. In the case of industrial gas turbine engines, the reduction of the emission of the oxides of nitrogen is of paramount importance and the air to fuel ratios are chosen accordingly. However in the case of marine gas turbine engines, the elimination of smoke is of greater importance and so engines for use in ,marine applications are so designed as to ensure that the appropriate air to fuel ratios for low smoke emission are employed as described above.

I claim:

1. Combustion apparatus suitable for a gas turbine engine comprising a combustion chamber having a fuel burner at its upstream end, said fuel burner comprising a generally tubular member having an upstream end and a downstream end, said upstream end being positioned externally of said combustion chamber and said downstream end being positioned within said combustion chamber, fuel conduit means having a fuel outlet opening defined within said tubular member and in facing relation to the radially inner walls of said tubular member for directing fuel against said radially inner walls, compressed air inlet means for directing compressed air into said tubular member, said tubular member directing a mixture of said compressed air and fuel into said combustion chamber, the downstream end of said tubular member being provided with a deflection member which is so configured as to cooperate with said tubular member to define a generally annular radially directed outlet with respect to the axis of said tubular member for said mixture of fuel and air, said radially directed outlet being located immediately downstream of the upstream end of said combustion chamber so that said mixture of fuel and air is urged into a single substantially toroidal fuel rich vortex in a first combustion zone situated in the upstream region of said combustion chamber, said combustion chamber being provided with additional air inlets downstream of said burner to direct air into a second combustion zone in said combustion chamber downstream of said toroidal vortex so as to render said second combustion zone fuel weak.

2. Combustion apparatus as claimed in claim 1 wherein a major portion of said tubular member is located externally of said combustion chamber.

3. Combustion apparatus as claimed in claim 1 wherein a fuel injector is provided at the upstream end of said tubular member to direct fuel on to the inner surface of said tubular member.

4. Combustion apparatus as claimed in claim 3 wherein said fuel injector is of the simplex type.

5. Combustion apparatus as claimed in claim 1 wherein said deflector member is attached to the downstream edge of said tubular member.

6. Combustion apparatus as claimed in claim 1 wherein the air to fuel ratio within said toroidal vortex is with the range 7/1 to 9/1.

7. Combustion apparatus as claimed in claim 6 wherein the air to fuel ratio within the region downstream of said toroidal vortex is within the range 22/1 to 25/1.

8. Combustion apparatus as claimed in claim 1 wherein the air to fuel ratio within said toroidal vortex is within the range 9/1 to 11/1.

9. Combustion apparatus as claimed in claim 8 wherein the air to fuel ratio within the region downstream of said toroidal vortex is within the range 20/1 to 22/1.

* * * * *